US008160827B2

(12) United States Patent
Jayanth et al.

(10) Patent No.: US 8,160,827 B2
(45) Date of Patent: Apr. 17, 2012

(54) COMPRESSOR SENSOR MODULE

(75) Inventors: Nagaraj Jayanth, Sidney, OH (US); Troy W. Renken, Camarillo, CA (US)

(73) Assignee: Emerson Climate Technologies, Inc., Sidney, OH (US)

( * ) Notice: Subject to any disclaimer, the term of this patent is extended or adjusted under 35 U.S.C. 154(b) by 752 days.

(21) Appl. No.: 12/261,677

(22) Filed: Oct. 30, 2008

(65) Prior Publication Data

US 2009/0125257 A1 May 14, 2009

Related U.S. Application Data

(60) Provisional application No. 60/984,909, filed on Nov. 2, 2007.

(51) Int. Cl.
*G06F 19/00* (2011.01)

(52) U.S. Cl. ..... 702/63

(58) Field of Classification Search ..... 702/64, 702/182–185

See application file for complete search history.

(56) References Cited

U.S. PATENT DOCUMENTS

| | | | |
|---|---|---|---|
| 2,054,542 | A | 9/1936 | Hoelle |
| 2,978,879 | A | 4/1961 | Heidom |
| 3,047,696 | A | 7/1962 | Heidom |
| 3,107,843 | A | 10/1963 | Finn |
| 3,170,304 | A | 2/1965 | Hale |
| 3,232,519 | A | 2/1966 | Long |
| 3,278,111 | A | 10/1966 | Parker |
| 3,665,399 | A | 5/1972 | Zehr et al. |
| 3,729,949 | A | 5/1973 | Talbot |
| 3,735,377 | A | 5/1973 | Kaufman |
| 3,742,303 | A | 6/1973 | Dageford |
| 3,783,681 | A | 1/1974 | Hirt et al. |
| 3,927,712 | A | 12/1975 | Nakayama |
| 3,935,519 | A | 1/1976 | Pfarrer et al. |
| 3,950,962 | A | 4/1976 | Odashima |
| 3,960,011 | A | 6/1976 | Renz et al. |
| 3,978,382 | A | 8/1976 | Pfarrer et al. |
| 3,998,068 | A | 12/1976 | Chirnside |

(Continued)

FOREIGN PATENT DOCUMENTS

DE 1403467 10/1969

(Continued)

OTHER PUBLICATIONS

First Office Action issued by the Chinese Patent Office regarding Application No. 200780030810.X dated Dec. 25, 2009.

(Continued)

*Primary Examiner* — Edward Raymond

(74) *Attorney, Agent, or Firm* — Harness, Dickey & Pierce, P.L.C.

(57) ABSTRACT

A sensor module for a compressor, having an electric motor operating at a first voltage, the sensor module operating at a second voltage, is provided. The sensor module includes a plurality of inputs connected to a plurality of sensors that generate a plurality of operating signals associated with operating conditions of the compressor. A processor is connected to the plurality of inputs and records multiple operating condition measurements from the plurality of operating signals. A communication port is connected to the processor for communicating said operating condition measurements to a control module that controls the compressor. The processor is disposed within an electrical enclosure of the compressor, the electrical enclosure being configured to house electrical terminals for connecting a power supply to the electric motor. The second voltage is less than said first voltage.

21 Claims, 6 Drawing Sheets

U.S. PATENT DOCUMENTS

| | | | |
|---|---|---|---|
| 4,014,182 | A | 3/1977 | Granryd |
| 4,018,584 | A | 4/1977 | Mullen |
| 4,024,725 | A | 5/1977 | Uchida et al. |
| 4,034,570 | A | 7/1977 | Anderson et al. |
| 4,038,061 | A | 7/1977 | Anderson et al. |
| 4,046,532 | A | 9/1977 | Nelson |
| 4,060,716 | A | 11/1977 | Pekrul et al. |
| 4,066,869 | A | 1/1978 | Apaloo et al. |
| 4,090,248 | A | 5/1978 | Swanson et al. |
| 4,102,394 | A | 7/1978 | Botts |
| 4,104,888 | A | 8/1978 | Reedy et al. |
| 4,105,063 | A | 8/1978 | Bergt |
| 4,112,703 | A | 9/1978 | Kountz |
| 4,136,730 | A | 1/1979 | Kinsey |
| 4,137,057 | A | 1/1979 | Piet et al. |
| 4,137,725 | A | 2/1979 | Martin |
| 4,142,375 | A | 3/1979 | Abe et al. |
| 4,143,707 | A | 3/1979 | Lewis et al. |
| 4,146,085 | A | 3/1979 | Wills |
| RE29,966 | E | 4/1979 | Nussbaum |
| 4,156,350 | A | 5/1979 | Elliott et al. |
| 4,161,106 | A | 7/1979 | Savage et al. |
| 4,165,619 | A | 8/1979 | Girard |
| 4,171,622 | A | 10/1979 | Yamaguchi et al. |
| 4,173,871 | A | 11/1979 | Brooks |
| RE30,242 | E | 4/1980 | del Toro et al. |
| 4,209,994 | A | 7/1980 | Mueller et al. |
| 4,211,089 | A | 7/1980 | Mueller et al. |
| 4,220,010 | A | 9/1980 | Mueller et al. |
| 4,227,862 | A | 10/1980 | Andrew et al. |
| 4,232,530 | A | 11/1980 | Mueller |
| 4,233,818 | A | 11/1980 | Lastinger |
| 4,236,379 | A | 12/1980 | Mueller |
| 4,244,182 | A | 1/1981 | Behr |
| 4,246,763 | A | 1/1981 | Mueller et al. |
| 4,248,051 | A | 2/1981 | Darcy et al. |
| 4,251,988 | A | 2/1981 | Allard et al. |
| 4,257,795 | A | 3/1981 | Shaw |
| 4,259,847 | A | 4/1981 | Pearse, Jr. |
| 4,267,702 | A | 5/1981 | Houk |
| 4,271,898 | A | 6/1981 | Freeman |
| 4,286,438 | A | 9/1981 | Clarke |
| 4,290,480 | A | 9/1981 | Sulkowski |
| 4,301,660 | A | 11/1981 | Mueller et al. |
| 4,307,775 | A | 12/1981 | Saunders |
| 4,311,188 | A | 1/1982 | Kojima et al. |
| 4,319,461 | A | 3/1982 | Shaw |
| 4,325,223 | A | 4/1982 | Cantley |
| 4,328,678 | A | 5/1982 | Kono et al. |
| 4,328,680 | A | 5/1982 | Stamp, Jr. et al. |
| 4,333,316 | A | 6/1982 | Stamp, Jr. et al. |
| 4,333,317 | A | 6/1982 | Sawyer |
| 4,336,001 | A | 6/1982 | Andrew et al. |
| 4,338,790 | A | 7/1982 | Saunders et al. |
| 4,338,791 | A | 7/1982 | Stamp, Jr. et al. |
| 4,345,162 | A | 8/1982 | Hammer et al. |
| 4,350,021 | A | 9/1982 | Lundstrom |
| 4,350,023 | A | 9/1982 | Kuwabara et al. |
| 4,356,703 | A | 11/1982 | Vogel |
| 4,361,273 | A | 11/1982 | Levine et al. |
| 4,365,983 | A | 12/1982 | Abraham et al. |
| 4,370,098 | A | 1/1983 | McClain et al. |
| 4,372,119 | A | 2/1983 | Gillbrand et al. |
| 4,381,549 | A | 4/1983 | Stamp, Jr. et al. |
| 4,382,367 | A | 5/1983 | Roberts |
| 4,384,462 | A | 5/1983 | Overman et al. |
| 4,387,368 | A | 6/1983 | Day et al. |
| 4,390,321 | A | 6/1983 | Langlois et al. |
| 4,390,922 | A | 6/1983 | Pelliccia |
| 4,395,886 | A | 8/1983 | Mayer |
| 4,395,887 | A | 8/1983 | Sweetman |
| 4,399,548 | A | 8/1983 | Castleberry |
| 4,406,133 | A | 9/1983 | Saunders et al. |
| 4,407,138 | A | 10/1983 | Mueller |
| 4,408,660 | A | 10/1983 | Sutoh et al. |
| 4,425,010 | A | 1/1984 | Bryant et al. |
| 4,429,578 | A | 2/1984 | Darrel et al. |
| 4,441,329 | A | 4/1984 | Dawley |
| 4,448,038 | A | 5/1984 | Barbier |
| 4,449,375 | A | 5/1984 | Briccetti |
| 4,460,123 | A | 7/1984 | Beverly |
| 4,463,571 | A | 8/1984 | Wiggs |
| 4,465,229 | A | 8/1984 | Kompelien |
| 4,467,230 | A | 8/1984 | Rovinsky |
| 4,467,385 | A | 8/1984 | Bandoli et al. |
| 4,467,613 | A | 8/1984 | Behr et al. |
| 4,470,092 | A | 9/1984 | Lombardi |
| 4,470,266 | A | 9/1984 | Briccetti et al. |
| 4,474,024 | A | 10/1984 | Eplett et al. |
| 4,479,389 | A | 10/1984 | Anderson, III et al. |
| 4,489,551 | A | 12/1984 | Watanabe et al. |
| 4,495,779 | A | 1/1985 | Tanaka et al. |
| 4,496,296 | A | 1/1985 | Arai et al. |
| 4,497,031 | A | 1/1985 | Froehling et al. |
| 4,498,310 | A | 2/1985 | Imanishi et al. |
| 4,499,739 | A | 2/1985 | Matsuoka et al. |
| 4,502,084 | A | 2/1985 | Hannett |
| 4,502,833 | A | 3/1985 | Hibino et al. |
| 4,502,842 | A | 3/1985 | Currier et al. |
| 4,502,843 | A | 3/1985 | Martin |
| 4,506,518 | A | 3/1985 | Yoshikawa et al. |
| 4,507,934 | A | 4/1985 | Tanaka et al. |
| 4,510,547 | A | 4/1985 | Rudich, Jr. |
| 4,510,576 | A | 4/1985 | MacArthur et al. |
| 4,512,161 | A | 4/1985 | Logan et al. |
| 4,516,407 | A | 5/1985 | Watabe |
| 4,520,674 | A | 6/1985 | Canada et al. |
| 4,523,435 | A | 6/1985 | Lord |
| 4,523,436 | A | 6/1985 | Schedel et al. |
| 4,527,399 | A | 7/1985 | Lord |
| 4,535,607 | A | 8/1985 | Mount |
| 4,538,420 | A | 9/1985 | Nelson |
| 4,538,422 | A | 9/1985 | Mount et al. |
| 4,539,820 | A | 9/1985 | Zinsmeyer |
| 4,545,210 | A | 10/1985 | Lord |
| 4,545,214 | A | 10/1985 | Kinoshita |
| 4,548,549 | A | 10/1985 | Murphy et al. |
| 4,549,403 | A | 10/1985 | Lord et al. |
| 4,549,404 | A | 10/1985 | Lord |
| 4,555,057 | A | 11/1985 | Foster |
| 4,557,317 | A | 12/1985 | Harmon, Jr. |
| 4,561,260 | A | 12/1985 | Nishi et al. |
| 4,563,624 | A | 1/1986 | Yu |
| 4,563,877 | A | 1/1986 | Harnish |
| 4,574,871 | A | 3/1986 | Parkinson et al. |
| 4,580,947 | A | 4/1986 | Shibata et al. |
| 4,583,373 | A | 4/1986 | Shaw |
| 4,589,060 | A | 5/1986 | Zinsmeyer |
| 4,598,764 | A | 7/1986 | Beckey |
| 4,602,484 | A | 7/1986 | Bendikson |
| 4,611,470 | A | 9/1986 | Enstrom |
| 4,612,775 | A | 9/1986 | Branz et al. |
| 4,614,089 | A | 9/1986 | Dorsey |
| 4,617,804 | A | 10/1986 | Fukushima et al. |
| 4,620,424 | A | 11/1986 | Tanaka et al. |
| 4,621,502 | A | 11/1986 | Ibrahim et al. |
| 4,627,245 | A | 12/1986 | Levine |
| 4,627,483 | A | 12/1986 | Harshbarger, III et al. |
| 4,627,484 | A | 12/1986 | Harshbarger, Jr. et al. |
| 4,630,670 | A | 12/1986 | Wellman et al. |
| 4,642,034 | A | 2/1987 | Terauchi |
| 4,646,532 | A | 3/1987 | Nose |
| 4,649,710 | A | 3/1987 | Inoue et al. |
| 4,653,280 | A | 3/1987 | Hansen et al. |
| 4,653,285 | A | 3/1987 | Pohl |
| 4,655,688 | A | 4/1987 | Bohn et al. |
| 4,660,386 | A | 4/1987 | Hansen et al. |
| 4,662,184 | A | 5/1987 | Pohl et al. |
| 4,674,292 | A | 6/1987 | Ohya et al. |
| 4,677,830 | A | 7/1987 | Sumikawa et al. |
| 4,680,940 | A | 7/1987 | Vaughn |
| 4,682,473 | A | 7/1987 | Rogers, III |
| 4,684,060 | A | 8/1987 | Adams et al. |
| 4,686,835 | A | 8/1987 | Alsenz |
| 4,689,967 | A | 9/1987 | Han et al. |
| 4,697,431 | A | 10/1987 | Alsenz |
| 4,698,978 | A | 10/1987 | Jones |

4,698,981 A 10/1987 Kaneko et al.
4,701,824 A 10/1987 Beggs et al.
4,706,152 A 11/1987 DeFilippis et al.
4,706,469 A 11/1987 Oguni et al.
4,712,648 A 12/1987 Mattes et al.
4,713,717 A 12/1987 Pejouhy et al.
4,715,190 A 12/1987 Han et al.
4,720,980 A 1/1988 Howland
4,735,054 A 4/1988 Beckey
4,735,060 A 4/1988 Alsenz
4,744,223 A 5/1988 Umezu
4,745,765 A 5/1988 Pettitt
4,745,766 A 5/1988 Bahr
4,745,767 A 5/1988 Ohya et al.
4,750,332 A 6/1988 Jenski et al.
4,750,672 A 6/1988 Beckey et al.
4,751,825 A 6/1988 Voorhis et al.
4,755,957 A 7/1988 White et al.
4,765,150 A 8/1988 Persem
4,768,348 A 9/1988 Noguchi
4,790,142 A 12/1988 Beckey
4,798,055 A 1/1989 Murray et al.
4,805,118 A 2/1989 Rishel
4,807,445 A 2/1989 Matsuoka et al.
4,829,779 A 5/1989 Munson et al.
4,831,560 A 5/1989 Zaleski
4,835,980 A 6/1989 Oyanagi et al.
4,841,734 A 6/1989 Torrence
4,845,956 A 7/1989 Berntsen et al.
4,848,099 A 7/1989 Beckey et al.
4,848,100 A 7/1989 Barthel et al.
4,850,198 A 7/1989 Helt et al.
4,850,204 A 7/1989 Bos et al.
4,852,363 A 8/1989 Kampf et al.
4,856,286 A 8/1989 Sulfstede et al.
4,858,676 A 8/1989 Bolfik et al.
4,866,944 A 9/1989 Yamazaki
4,869,073 A 9/1989 Kawai et al.
4,873,836 A 10/1989 Thompson
4,878,355 A 11/1989 Beckey et al.
4,881,184 A 11/1989 Abegg, III et al.
4,882,908 A 11/1989 White
4,884,412 A 12/1989 Sellers et al.
4,885,707 A 12/1989 Nichol et al.
4,885,914 A 12/1989 Pearman
4,887,436 A 12/1989 Enomoto et al.
4,887,857 A 12/1989 VanOmmeren
4,889,280 A 12/1989 Grald et al.
4,893,480 A 1/1990 Matsui et al.
4,899,551 A 2/1990 Weintraub
4,903,500 A 2/1990 Hanson
4,909,041 A 3/1990 Jones
4,909,076 A 3/1990 Busch et al.
4,910,966 A 3/1990 Levine et al.
4,913,625 A 4/1990 Gerlowski
4,916,912 A 4/1990 Levine et al.
4,918,932 A 4/1990 Gustafson et al.
4,932,588 A 6/1990 Fedter et al.
4,939,909 A 7/1990 Tsuchiyama et al.
4,943,003 A 7/1990 Shimizu et al.
4,944,160 A 7/1990 Malone et al.
4,945,491 A 7/1990 Rishel
4,953,784 A 9/1990 Yasufuku et al.
4,959,970 A 10/1990 Meckler
4,964,060 A 10/1990 Hartsog
4,966,006 A 10/1990 Thuesen et al.
4,967,567 A 11/1990 Proctor et al.
4,974,665 A 12/1990 Zillner, Jr.
4,975,024 A 12/1990 Heckel
4,977,751 A 12/1990 Hanson
4,985,857 A 1/1991 Bajpai et al.
4,987,748 A 1/1991 Meckler
4,990,057 A 2/1991 Rollins
4,991,770 A 2/1991 Bird et al.
5,000,009 A 3/1991 Clanin
5,009,075 A 4/1991 Okoren
5,009,076 A 4/1991 Winslow
5,018,665 A 5/1991 Sulmone
RE33,620 E 6/1991 Persem
5,042,264 A 8/1991 Dudley
5,056,036 A 10/1991 Van Bork
5,056,329 A 10/1991 Wilkinson
5,058,388 A 10/1991 Shaw et al.
5,062,278 A 11/1991 Sugiyama
5,065,593 A 11/1991 Dudley et al.
RE33,775 E 12/1991 Behr et al.
5,071,065 A 12/1991 Aalto et al.
5,073,091 A 12/1991 Burgess et al.
5,073,862 A 12/1991 Carlson
5,076,067 A 12/1991 Prenger et al.
5,076,494 A 12/1991 Ripka
5,077,983 A 1/1992 Dudley
5,094,086 A 3/1992 Shyu
5,095,712 A 3/1992 Narreau
5,095,715 A 3/1992 Dudley
5,103,391 A 4/1992 Barrett
5,109,676 A 5/1992 Waters et al.
5,109,700 A 5/1992 Hicho
5,115,406 A 5/1992 Zatezalo et al.
5,115,643 A 5/1992 Hayata et al.
5,115,644 A 5/1992 Alsenz
5,118,260 A 6/1992 Fraser, Jr.
5,119,466 A 6/1992 Suzuki
5,119,637 A 6/1992 Bard et al.
5,121,610 A 6/1992 Atkinson et al.
5,123,252 A 6/1992 Hanson
5,123,253 A 6/1992 Hanson et al.
5,123,255 A 6/1992 Ohizumi
5,141,407 A 8/1992 Ramsey et al.
5,142,877 A 9/1992 Shimizu
5,167,494 A 12/1992 Inagaki et al.
5,170,935 A 12/1992 Federspiel et al.
5,170,936 A 12/1992 Kubo et al.
5,186,014 A 2/1993 Runk
5,199,855 A 4/1993 Nakajima et al.
5,200,872 A 4/1993 D'Entremont et al.
5,201,862 A 4/1993 Pettitt
5,203,178 A 4/1993 Shyu
5,209,076 A 5/1993 Kauffman et al.
5,209,400 A 5/1993 Winslow et al.
5,219,041 A 6/1993 Greve
5,224,354 A 7/1993 Ito et al.
5,224,835 A 7/1993 Oltman
5,228,300 A 7/1993 Shim
5,228,307 A 7/1993 Koce
5,231,844 A 8/1993 Park
5,233,841 A 8/1993 Jyrek
5,237,830 A 8/1993 Grant
5,241,833 A 9/1993 Ohkoshi
5,243,829 A 9/1993 Bessler
5,248,244 A 9/1993 Ho et al.
5,251,454 A 10/1993 Yoon
5,257,506 A 11/1993 DeWolf et al.
5,271,556 A 12/1993 Helt et al.
5,276,630 A 1/1994 Baldwin et al.
5,279,458 A 1/1994 DeWolf et al.
5,290,154 A 3/1994 Kotlarek et al.
5,291,752 A 3/1994 Alvarez et al.
5,299,504 A 4/1994 Abele
5,303,560 A 4/1994 Hanson et al.
5,311,451 A 5/1994 Barrett
5,320,506 A 6/1994 Fogt
5,335,507 A 8/1994 Powell
5,336,058 A 8/1994 Yokoyama
5,362,206 A 11/1994 Westerman et al.
5,362,211 A 11/1994 Iizuka et al.
5,368,446 A 11/1994 Rode
5,381,669 A 1/1995 Bahel et al.
5,381,692 A 1/1995 Winslow et al.
5,416,781 A 5/1995 Ruiz
5,423,190 A 6/1995 Friedland
5,423,192 A 6/1995 Young et al.
5,440,890 A 8/1995 Bahel et al.
5,440,895 A 8/1995 Bahel et al.
5,446,677 A 8/1995 Jensen et al.
5,454,229 A 10/1995 Hanson et al.
5,460,006 A 10/1995 Torimitsu
5,475,986 A 12/1995 Bahel et al.

5,481,481 A 1/1996 Frey et al.
5,499,512 A 3/1996 Jurewicz et al.
5,509,786 A 4/1996 Mizutani et al.
5,511,387 A 4/1996 Tinsler
5,528,908 A 6/1996 Bahel et al.
5,533,347 A 7/1996 Ott et al.
5,535,597 A 7/1996 An
5,546,015 A 8/1996 Okabe
5,548,966 A 8/1996 Tinsler
5,562,426 A 10/1996 Watanabe et al.
5,579,648 A 12/1996 Hanson et al.
5,586,445 A 12/1996 Bessler
5,592,824 A 1/1997 Sogabe et al.
5,596,507 A 1/1997 Jones et al.
5,602,757 A 2/1997 Haseley et al.
5,610,339 A 3/1997 Haseley et al.
5,611,674 A 3/1997 Bass et al.
5,613,841 A 3/1997 Bass et al.
5,616,829 A 4/1997 Balaschak et al.
5,623,834 A 4/1997 Bahel et al.
5,628,201 A 5/1997 Bahel et al.
5,630,325 A 5/1997 Bahel et al.
5,641,270 A 6/1997 Sgourakes et al.
5,655,379 A 8/1997 Jaster et al.
5,689,963 A 11/1997 Bahel et al.
5,691,692 A 11/1997 Herbstritt
5,699,670 A 12/1997 Jurewicz et al.
5,707,210 A 1/1998 Ramsey et al.
5,713,724 A 2/1998 Centers et al.
5,737,931 A 4/1998 Ueno et al.
5,741,120 A 4/1998 Bass et al.
5,754,450 A 5/1998 Solomon et al.
5,772,403 A 6/1998 Allison et al.
5,795,381 A 8/1998 Holder
5,798,941 A 8/1998 McLeister
5,807,336 A 9/1998 Russo et al.
5,808,441 A 9/1998 Nehring
5,869,960 A 2/1999 Brand
5,875,638 A 3/1999 Tinsler
5,884,494 A 3/1999 Okoren et al.
5,924,295 A 7/1999 Park
5,947,701 A 9/1999 Hugenroth
5,956,658 A 9/1999 McMahon
5,971,712 A 10/1999 Kann
5,975,854 A 11/1999 Culp, III et al.
5,984,645 A 11/1999 Cummings
5,988,986 A 11/1999 Brinken et al.
5,995,347 A 11/1999 Rudd et al.
5,995,351 A 11/1999 Katsumata et al.
6,017,192 A 1/2000 Clack et al.
6,020,702 A 2/2000 Farr
6,023,420 A * 2/2000 McCormick et al. ..... 363/131
6,035,661 A 3/2000 Sunaga et al.
6,041,605 A 3/2000 Heinrichs
6,041,609 A 3/2000 Hornsleth et al.
6,042,344 A 3/2000 Lifson
6,047,557 A 4/2000 Pham et al.
6,050,780 A 4/2000 Hasegawa et al.
6,057,771 A 5/2000 Lakra
6,065,946 A 5/2000 Lathrop
6,068,447 A 5/2000 Foege
6,077,051 A 6/2000 Centers et al.
6,081,750 A 6/2000 Hoffberg et al.
6,082,495 A 7/2000 Steinbarger et al.
6,082,971 A 7/2000 Gunn et al.
6,085,530 A 7/2000 Barito
6,092,370 A 7/2000 Tremoulet, Jr. et al.
6,092,378 A 7/2000 Das et al.
6,092,992 A 7/2000 Imblum et al.
6,102,665 A 8/2000 Centers et al.
6,125,642 A 10/2000 Seener et al.
6,128,583 A 10/2000 Dowling
6,129,527 A 10/2000 Donahoe et al.
6,157,310 A 12/2000 Milne et al.
6,158,230 A 12/2000 Katsuki
6,174,136 B1 1/2001 Kilayko et al.
6,176,686 B1 1/2001 Wallis et al.
6,179,214 B1 1/2001 Key et al.
6,199,018 B1 3/2001 Quist et al.
6,260,004 B1 7/2001 Hays et al.
6,276,901 B1 8/2001 Farr et al.
6,279,332 B1 8/2001 Yeo et al.
6,302,654 B1 10/2001 Millet et al.
6,324,854 B1 12/2001 Jayanth
6,332,327 B1 12/2001 Street et al.
6,360,551 B1 3/2002 Renders
6,375,439 B1 4/2002 Missio
6,381,971 B2 5/2002 Honda
6,390,779 B1 5/2002 Cunkelman
6,406,265 B1 6/2002 Hahn et al.
6,406,266 B1 6/2002 Hugenroth et al.
6,412,293 B1 7/2002 Pham et al.
6,438,981 B1 8/2002 Whiteside
6,442,953 B1 9/2002 Trigiani et al.
6,449,972 B2 9/2002 Pham et al.
6,450,771 B1 9/2002 Centers et al.
6,453,687 B2 9/2002 Sharood et al.
6,454,538 B1 9/2002 Witham et al.
6,457,319 B1 10/2002 Ota et al.
6,457,948 B1 10/2002 Pham
6,467,280 B2 10/2002 Pham et al.
6,471,486 B1 10/2002 Centers et al.
6,484,520 B2 11/2002 Kawaguchi et al.
6,487,457 B1 11/2002 Hull et al.
6,492,923 B1 12/2002 Inoue et al.
6,497,554 B2 12/2002 Yang et al.
6,501,240 B2 12/2002 Ueda et al.
6,501,629 B1 12/2002 Marriott
6,502,409 B1 1/2003 Gatling et al.
6,505,475 B1 1/2003 Zugibe et al.
6,529,590 B1 3/2003 Centers
6,533,552 B2 3/2003 Centers et al.
6,537,034 B2 3/2003 Park et al.
6,542,062 B1 4/2003 Herrick
6,558,126 B1 5/2003 Hahn et al.
6,560,976 B2 5/2003 Jayanth
6,571,566 B1 6/2003 Temple et al.
6,595,757 B2 7/2003 Shen
6,601,397 B2 8/2003 Pham et al.
6,615,594 B2 9/2003 Jayanth et al.
6,616,415 B1 9/2003 Renken et al.
6,629,420 B2 10/2003 Renders
6,647,735 B2 11/2003 Street et al.
6,658,373 B2 12/2003 Rossi et al.
6,675,591 B2 1/2004 Singh et al.
6,679,072 B2 1/2004 Pham et al.
6,685,438 B2 2/2004 Yoo et al.
6,709,244 B2 3/2004 Pham
6,711,911 B1 3/2004 Grabon et al.
6,758,050 B2 7/2004 Jayanth et al.
6,758,051 B2 7/2004 Jayanth et al.
6,760,207 B2 7/2004 Wyatt et al.
6,799,951 B2 10/2004 Lifson et al.
6,811,380 B2 11/2004 Kim
6,823,680 B2 11/2004 Jayanth
6,829,542 B1 12/2004 Reynolds et al.
6,832,120 B1 12/2004 Frank et al.
6,832,898 B2 12/2004 Yoshida et al.
6,869,272 B2 3/2005 Odachi et al.
6,934,862 B2 8/2005 Sharood et al.
6,964,558 B2 11/2005 Hahn et al.
6,966,759 B2 11/2005 Hahn et al.
6,973,794 B2 12/2005 Street et al.
6,981,384 B2 1/2006 Dobmeier et al.
6,986,469 B2 1/2006 Gauthier et al.
6,999,996 B2 2/2006 Sunderland
7,000,422 B2 2/2006 Street et al.
7,047,753 B2 5/2006 Street et al.
7,079,967 B2 7/2006 Rossi et al.
7,113,376 B2 9/2006 Nomura et al.
7,123,458 B2 10/2006 Mohr et al.
7,130,170 B2 10/2006 Wakefield et al.
7,134,295 B2 11/2006 Maekawa
7,174,728 B2 2/2007 Jayanth
7,228,691 B2 6/2007 Street et al.
7,270,278 B2 9/2007 Street et al.
7,412,842 B2 8/2008 Pham
7,421,850 B2 9/2008 Street et al.

| | | | | |
|---|---|---|---|---|
| 7,447,603 | B2 | 11/2008 | Bruno | |
| 7,458,223 | B2 | 12/2008 | Pham | |
| 7,484,376 | B2 | 2/2009 | Pham | |
| 7,491,034 | B2 * | 2/2009 | Jayanth | 417/44.1 |
| 2001/0005320 | A1 | 6/2001 | Ueda et al. | |
| 2001/0054293 | A1 | 12/2001 | Gustafson et al. | |
| 2002/0018724 | A1 | 2/2002 | Millet et al. | |
| 2002/0020175 | A1 | 2/2002 | Street et al. | |
| 2002/0040280 | A1 | 4/2002 | Morgan | |
| 2002/0064463 | A1 | 5/2002 | Park et al. | |
| 2002/0067999 | A1 | 6/2002 | Suitou et al. | |
| 2002/0127120 | A1 | 9/2002 | Hahn et al. | |
| 2002/0170299 | A1 | 11/2002 | Jayanth et al. | |
| 2003/0019221 | A1 | 1/2003 | Rossi et al. | |
| 2003/0037555 | A1 | 2/2003 | Street et al. | |
| 2003/0078742 | A1 | 4/2003 | VanderZee et al. | |
| 2003/0108430 | A1 | 6/2003 | Yoshida et al. | |
| 2003/0115890 | A1 | 6/2003 | Jayanth et al. | |
| 2004/0016241 | A1 | 1/2004 | Street et al. | |
| 2004/0016244 | A1 | 1/2004 | Street et al. | |
| 2004/0016251 | A1 | 1/2004 | Street et al. | |
| 2004/0016253 | A1 | 1/2004 | Street et al. | |
| 2004/0024495 | A1 | 2/2004 | Sunderland | |
| 2004/0037706 | A1 | 2/2004 | Hahn et al. | |
| 2004/0042904 | A1 | 3/2004 | Kim | |
| 2004/0093879 | A1 | 5/2004 | Street et al. | |
| 2004/0133367 | A1 | 7/2004 | Hart | |
| 2004/0184627 | A1 | 9/2004 | Kost et al. | |
| 2004/0184928 | A1 | 9/2004 | Millet et al. | |
| 2004/0184929 | A1 | 9/2004 | Millet et al. | |
| 2004/0184930 | A1 | 9/2004 | Millet et al. | |
| 2004/0184931 | A1 | 9/2004 | Millet et al. | |
| 2004/0187502 | A1 | 9/2004 | Jayanth et al. | |
| 2004/0191073 | A1 | 9/2004 | Iimura et al. | |
| 2004/0261431 | A1 | 12/2004 | Singh et al. | |
| 2005/0053471 | A1 | 3/2005 | Hong et al. | |
| 2005/0100449 | A1 | 5/2005 | Hahn et al. | |
| 2005/0103036 | A1 | 5/2005 | Maekawa | |
| 2005/0166610 | A1 | 8/2005 | Jayanth | |
| 2005/0214148 | A1 | 9/2005 | Ogawa et al. | |
| 2005/0232781 | A1 | 10/2005 | Herbert et al. | |
| 2005/0235661 | A1 | 10/2005 | Pham | |
| 2005/0235663 | A1 | 10/2005 | Pham | |
| 2005/0252220 | A1 | 11/2005 | Street et al. | |
| 2005/0262856 | A1 | 12/2005 | Street et al. | |
| 2006/0117773 | A1 | 6/2006 | Street et al. | |
| 2006/0129339 | A1 | 6/2006 | Bruno | |
| 2006/0185373 | A1 | 8/2006 | Butler et al. | |
| 2006/0256488 | A1 | 11/2006 | Benzing et al. | |
| 2006/0280627 | A1 | 12/2006 | Jayanth | |
| 2007/0002505 | A1 | 1/2007 | Watanabe et al. | |
| 2008/0209925 | A1 | 9/2008 | Pham | |
| 2008/0216494 | A1 | 9/2008 | Pham et al. | |
| 2009/0071175 | A1 | 3/2009 | Pham | |

FOREIGN PATENT DOCUMENTS

| | | | |
|---|---|---|---|
| DE | 3118638 | | 7/1995 |
| DE | 297 23 145 | U1 | 4/1998 |
| EP | 0060172 | A1 | 9/1982 |
| EP | 0085246 | | 8/1983 |
| EP | 0 355 255 | | 2/1990 |
| EP | 0453302 | | 10/1991 |
| EP | 0351272 | | 5/1994 |
| EP | 0877462 | | 11/1998 |
| EP | 1 087 184 | A2 | 9/2000 |
| EP | 1245912 | | 10/2002 |
| FR | 2 472 862 | | 3/1981 |
| GB | 2062919 | | 5/1981 |
| JP | 63061783 | | 3/1988 |
| JP | 02110242 | | 4/1990 |
| JP | 02 294580 | A | 5/1990 |
| JP | 06 058273 | A | 1/1994 |
| JP | 2002-155868 | | 5/2002 |
| JP | 2003-176788 | | 6/2003 |
| JP | 2004-316504 | | 11/2004 |
| JP | 2006-046219 | | 2/2006 |
| KR | 10-2000-0025265 | | 5/2000 |
| KR | 10-2002-0041977 | | 6/2002 |
| KR | 10-2004-0021281 | | 3/2004 |
| KR | 10-2006-0020353 | | 3/2006 |
| WO | 8806703 | A1 | 9/1988 |
| WO | WO 97 18636 | | 5/1997 |
| WO | WO 99 17066 | | 4/1999 |
| WO | WO 01/69147 | A1 | 9/2001 |
| WO | WO 02/075227 | | 9/2002 |
| WO | WO 2005/108882 | | 11/2005 |
| WO | WO 2006/025880 | | 3/2006 |
| WO | 2009/058356 | | 5/2009 |

OTHER PUBLICATIONS

"Small-type Freezing and Air Conditioning Operation," Chinese State Economy and Trading Committee, China Meteorological Press, Mar. 2003 (cited in First Office Action issued by the Chinese Patent Office regarding Application No. 200780030810.X dated Dec. 25, 2009).

"Manual for Freezing and Air Conditioning Technology," Fan Jili, Liaoning Science and Technology Press, Sep. 1995 (cited in First Office Action issued by the Chinese Patent Office regarding Application No. 200780030810.X dated Dec. 25, 2009).

Office Action regarding U.S. Appl. No. 11/776,879, dated Sep. 17, 2010.

Non-Final Office Action regarding U.S. Appl. No. 12/261,643, dated Jan. 27, 2011.

First Office Action regarding Chinese Patent Application No. 200780032977.X, dated Sep. 27, 2010. English translation provided by Unitalen Attorneys at Law.

First Office Action regarding Chinese Patent Application No. 201010117657.8, dated Dec. 29, 2010. English translation provided by Unitalen Attorneys at Law.

International Preliminary Report on Patentability for International Application No. PCT/US2008/012362, dated May 4, 2010.

International Preliminary Report on Patentability for International Application No. PCT/US2008/012364, dated May 4, 2010.

The International Search Report regarding International Application No. PCT/US2007/019563.

Written Opinion of the International Searching Authority regarding International Application No. PCT/US2007/019563.

Einstein RX-300 Refrigeration Controller Installation and Operation Manual, Computer Process Controls, Apr. 1, 1998.

Translation of Claims and Abstract of KR Patent Laying-Open No. 2000-0000261; 4 pages.

International Search Report for International Application No. PCT/US2008/012362, dated Feb. 12, 2009.

International Search Report for International Application No. PCT/US2008/012364 dated Mar. 13, 2009.

Written Opinion of the International Searching Authority for International Application No. PCT/US2008/012364 dated Mar. 13, 2009.

International Search Report for International Application No. PCT/US2007/016135 dated Oct. 22, 2007.

International Preliminary Report on Patentability regarding International Application No. PCT/US2007/019563 dated Mar. 10, 2009.

International Search Report for International Application No. PCT/US2005/11154, dated Oct. 19, 2005.

First Office Action issued by the Chinese Patent Office on May 30, 2008 regarding Application No. 200580013451.8.

Second Office Action issued by the Chinese Patent Office on Mar. 6, 2009 regarding Application No. 200580013451.8.

Third Office Action issued by the Chinese Patent Office on Jun. 19, 2009 regarding Application No. 200580013451.8, translated by CCPIT Patent and Trademark Law Office.

First Office Action from the Patent Office of the People's Republic of China regarding Application No. 200510005907.8, dated Jun. 29, 2007.

"A Practical Example of a Building's Automatic Control," cited in First Office Action from the Patent Office of the People's Republic of China dated Jun. 29, 2007, regarding Application No. 200510005907.8, including translation by CCPIT Patent and Trademark Law Office.

"Product Performance Introduction of York Company," cited in First Office Action from the Patent Office of the People's Republic of China dated Jun. 29, 2007 regarding Application No. 200510005907.8, including translation by CCPIT Patent and Trademark Law Office.
Second Office action issued by the Chinese Patent Office dated Jun. 19, 2009 regarding Application No. 200510005907.8, translation provided by CCPIT Patent and Trademark Law Office.
Ultrasite 32 User's Guide, Computer Process Controls, Sep. 28, 1999.
Ultrasite User's Guide BEC Supplement, Computer Process Controls, Oct. 6, 1997.
Ultrasite User's Guide BCU Supplement, Computer Process Controls, Sep. 4, 1997.
Ultrasite User's Guide RMCC Supplement, Computer Process Controls, Jun. 9, 1997.
Refrigeration Monitor and Case Control Installation and Operation Manual, Computer Process Controls, Aug. 12, 1999.
Building Environmental Control (BEC) Installation and Operation Manual, Computer Process Controls, Jan. 5, 1998.
Building Control Unit (BCU) Installation and Operation Manual, Computer Process Controls, Jan. 28, 1998.
Final Office Action regarding U.S. Appl. No. 12/261,643, dated Jul. 7, 2011.
Office Action regarding U.S. Appl. No. 12/261,643, dated Nov. 2, 2011.
Office Action regarding U.S. Appl. No. 11/850,846, dated Aug. 13, 2010.
Second Office Action regarding Chinese Patent Application No. 200780030810X, dated Aug. 4, 2010. English translation provided by Unitalen Attorneys at Law.

* cited by examiner

COMPRESSOR SENSOR MODULE

CROSS-REFERENCE TO RELATED APPLICATIONS

This application claims the benefit of U.S. Provisional Application No. 60/984,909, filed on Nov. 2, 2007. The entire disclosure of the above application is incorporated herein by reference.

FIELD

The present disclosure relates to compressors, and more particularly, to a compressor sensor module.

BACKGROUND

The statements in this section merely provide background information related to the present disclosure and may not constitute prior art.

Compressors are used in a variety of industrial and residential applications to circulate refrigerant within a refrigeration, heat pump, HVAC, or chiller system (generically "refrigeration systems") to provide a desired heating or cooling effect. In each application, it is desirable for the compressor to provide consistent and efficient operation to ensure that the refrigeration system functions properly. To this end, it is desirable to monitor data received from various sensors that continually measure various operating parameters of the compressor. Electrical sensors may monitor electrical power. Pressure sensors may monitor compressor suction and discharge pressure. Temperature sensors may monitor compressor suction and discharge temperatures as well as ambient temperature. In addition, temperature sensors may monitor an electric motor temperature or an oil temperature of the compressor. Further sensors may monitor oil level and oil pressure of the compressor.

Electrical power is delivered to the electric motor of the compressor by a power supply. For example three phase high voltage power may be used.

SUMMARY

A sensor module is provided for a compressor having an electric motor operating at a first voltage. The sensor module may operate at a second voltage and may comprise a plurality of inputs connected to a plurality of sensors that may generate a plurality of operating signals associated with operating conditions of the compressor. The sensor module may also comprise a processor connected to the plurality of inputs that records multiple operating condition measurements from the plurality of operating signals and a communication port connected to the processor for communicating the operating condition measurements to a control module that controls the compressor. The processor may be disposed within an electrical enclosure of the compressor, with the electrical enclosure being configured to house electrical terminals for connecting a power supply operating at the first voltage to the electric motor and with the second voltage being less than the first voltage.

In other features, a transformer may be located within the electrical enclosure and may generate the second voltage from the power supply.

In other features, the processor may be disposed within a tamper-resistant enclosure within the electrical enclosure.

In other features, the plurality of sensors may include a voltage sensor that may generate a voltage signal corresponding to a sensed voltage of the power supply.

In other features, the plurality of sensors may include a current sensor that may generate a current signal corresponding to a sensed current of the power supply.

In other features, the plurality of sensors may include a discharge temperature sensor that generates a discharge temperature signal corresponding to a discharge temperature of the compressor and/or a suction temperature sensor that generates a suction temperature signal corresponding to a suction temperature of the compressor.

In other features, the plurality of sensors may include a discharge pressure sensor that may generates a discharge pressure signal corresponding to a discharge pressure of the compressor and/or a suction pressure sensor that may generate a suction pressure signal corresponding to a suction pressure of the compressor.

In other features, the plurality of sensors may include at least one electric motor temperature sensor that may generate an electric motor temperature signal corresponding to a temperature of the electric motor of the compressor.

In other features, the plurality of sensors may include an oil temperature sensor that may generate an oil temperature signal corresponding to a temperature of oil of the compressor, an oil level sensor that may generate an oil level signal corresponding to an oil level of the compressor, and an oil pressure sensor that may generate an oil pressure signal corresponding to an oil pressure of the compressor.

In other features, the second voltage may be between 18 volts and 30 volts.

In other features, the second voltage may be 24 volts.

Another sensor module for a compressor having an electric motor connected to a three phase power supply is provided. The sensor module may be powered by single phase power derived from the three phase power supply. The sensor module may comprise a plurality of inputs connected to a plurality of sensors that may generate a plurality of operating signals associated with operating conditions of the compressor, a processor connected to the plurality of inputs that records multiple operating condition measurements from the plurality of operating signals, and a communication port connected to the processor for communicating the operating condition measurements to a control module that controls the compressor. The processor may be disposed within an electrical enclosure of the compressor and the electrical enclosure may be configured to house electrical terminals for connecting the power supply to the electric motor. An operating voltage of the single phase power may be less than an operating voltage of the three phase power.

In other features, the processor may be disposed within a tamper-resistant enclosure within the electrical enclosure.

In other features, a transformer may be connected to the three phase power supply to generate the single phase power. The transformer may be located within the electrical enclosure.

In other features, the plurality of sensors may include a first voltage sensor that may generate a first voltage signal corresponding to a voltage of a first phase of the three phase power supply, a second voltage sensor that may generate a second voltage signal corresponding to a voltage of a second phase of the three phase power supply, and a third voltage sensor that may generate a third voltage signal corresponding to a voltage of a third phase of the three phase power supply.

In other features, the plurality of sensors may include a current sensor that may generate a current signal corresponding to a current of one of the first, second, and third phases the three phase power supply.

In other features, the operating voltage of the single phase power may be between 18 volts and 30 volts.

In other features, the operating voltage of the single phase power may be 24 volts.

A method for a sensor module with a processor disposed within an electrical enclosure of a compressor having an electric motor, the electrical enclosure being configured to house electrical terminals for connecting the electric motor to a power supply at a first operating voltage, is also provided. The method may comprise connecting the sensor module to a transformer for generating a second operating voltage from the power supply, the first operating voltage being higher than the second operating voltage, connecting the electrical terminals to the power supply operating at the first operating voltage, receiving voltage measurements of the power supply from a voltage sensor connected to the sensor module, receiving current measurements of the power supply from a current sensor connected to the sensor module, and communicating operating information based on the current and voltage measurements to a control module connected to the sensor module via a communication port of the sensor module.

In other features, the method may further comprise receiving a temperature associated with the compressor from a temperature sensor connected to the sensor module and communicating operating information based on the temperature to the control module. The temperature may include a suction temperature of the compressor, a discharge temperature of the compressor, an ambient temperature, an oil temperature of the compressor, and/or an electric motor temperature of the compressor.

In other features, the method may further comprise receiving a pressure associated with the compressor from a pressure sensor connected to the sensor module and communicating operating information based on the pressure to the control module. The pressure may include a suction pressure of the compressor and/or a discharge pressure of the compressor.

A system is also provided that may comprise a compressor having an electric motor operating at a first voltage, a control module that controls the compressor, and a sensor module operating at a second voltage. The sensor module may have a plurality of inputs connected to a plurality of sensors that generate a plurality of operating signals associated with operating conditions of the compressor, a processor connected to the plurality of inputs that records multiple operating condition measurements from the plurality of operating signals, and a communication port connected to the processor for communicating the operating condition measurements to the control module. The processor may be disposed within an electrical enclosure of the compressor. The electrical enclosure may be configured to house electrical terminals for connecting a power supply operating at the first voltage to the electric motor. The second voltage may be less than the first voltage.

In other features, the system may further comprise a transformer located within the electrical enclosure that generates the second voltage from the power supply.

In other features, the processor may be disposed within a tamper-resistant enclosure within the electrical enclosure.

In other features, the plurality of sensors may include a voltage sensor that generates a voltage signal corresponding to a sensed voltage of the power supply.

In other features, the plurality of sensors may include a current sensor that may generate a current signal corresponding to a sensed current of the power supply.

In other features, the plurality of sensors may include a discharge temperature sensor that may generate a discharge temperature signal corresponding to a discharge temperature of the compressor and/or a suction temperature sensor that may generate a suction temperature signal corresponding to a suction temperature of the compressor.

In other features, the plurality of sensors may include a discharge pressure sensor that may generate a discharge pressure signal corresponding to a discharge pressure of the compressor and/or a suction pressure sensor that generates a suction pressure signal corresponding to a suction pressure of the compressor.

In other features, the plurality of sensors may include at least one electric motor temperature sensor that may generate an electric motor temperature signal corresponding to a temperature of the electric motor of the compressor.

In other features, the plurality of sensors may include an oil temperature sensor that may generate an oil temperature signal corresponding to a temperature of oil of the compressor, an oil level sensor that may generate an oil level signal corresponding to an oil level of the compressor, and/or an oil pressure sensor that may generate an oil pressure signal corresponding to an oil pressure of the compressor.

In other features, the second voltage may be between 18 volts and 30 volts.

In other features, the second voltage may be 24 volts.

Another system is provided that may comprise a compressor having an electric motor connected to a three phase power supply, a control module that controls the compressor, and a sensor module powered by single phase power derived from the three phase power supply. The sensor module may have a plurality of inputs connected to a plurality of sensors that generate a plurality of operating signals associated with operating conditions of the compressor, a processor connected to the plurality of inputs that records multiple operating condition measurements from the plurality of operating signals, and a communication port connected to the processor for communicating the operating condition measurements to a control module that controls the compressor. The processor may be disposed within an electrical enclosure of the compressor. The electrical enclosure may be configured to house electrical terminals for connecting the power supply to the electric motor. An operating voltage of the single phase power may be less than an operating voltage of the three phase power.

In other features, the processor may be disposed within a tamper-resistant enclosure within the electrical enclosure.

In other features, a transformer may be connected to the three phase power supply to generate the single phase power. The transformer may be located within the electrical enclosure.

In other features, the plurality of sensors may include a first voltage sensor that may generate a first voltage signal corresponding to a voltage of a first phase of the three phase power supply, a second voltage sensor that may generate a second voltage signal corresponding to a voltage of a second phase of the three phase power supply, and a third voltage sensor that generates a third voltage signal corresponding to a voltage of a third phase of the three phase power supply.

In other features, the plurality of sensors may include a current sensor that may generate a current signal corresponding to a current of one of the first, second, and third phases the three phase power supply.

In other features, the operating voltage of the single phase power may be between 18 volts and 30 volts.

In other features, the operating voltage of the single phase power may be 24 volts.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
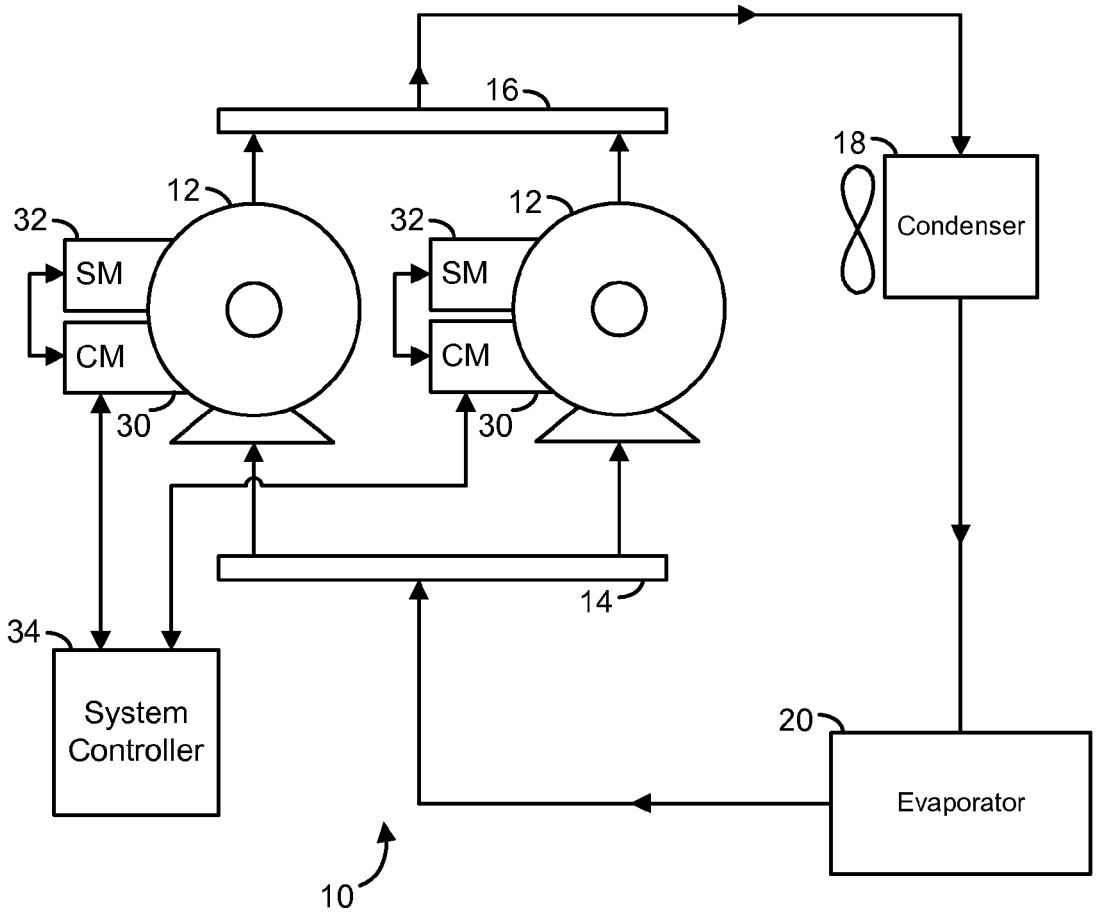
FIG. 1 is a schematic view of a refrigeration system.

The following description is merely exemplary in nature and is not intended to limit the present disclosure, application, or uses. It should be understood that throughout the drawings, corresponding reference numerals indicate like or corresponding parts and features.

As used herein, the terms module, control module, and controller refer to one or more of the following: an application specific integrated circuit (ASIC), an electronic circuit, a processor (shared, dedicated, or group) and memory that execute one or more software or firmware programs, a combinational logic circuit, or other suitable components that provide the described functionality. Further, as used herein, computer-readable medium refers to any medium capable of storing data for a computer. Computer-readable medium may include, but is not limited to, memory, RAM, ROM, PROM, EPROM, EEPROM, flash memory, punch cards, dip switches, CD-ROM, floppy disk, magnetic tape, other magnetic medium, optical medium, or any other device or medium capable of storing data for a computer.

With reference to FIG. 1, an exemplary refrigeration system 10 may include a plurality of compressors 12 piped together with a common suction manifold 14 and a discharge header 16. Compressor 12 may be a reciprocating compressor, a scroll type compressor, or another type compressor. Compressor 12 may include a crank case. The compressors 12 may be equipped with electric motors to compress refrigerant vapor that is delivered to a condenser 18 where the refrigerant vapor is liquefied at high pressure, thereby rejecting heat to the outside air. The liquid refrigerant exiting the condenser 18 is delivered to an evaporator 20. As hot air moves across the evaporator, the liquid turns into gas, thereby removing heat from the air and cooling a refrigerated space. This low pressure gas is delivered to the compressors 12 and again compressed to a high pressure gas to start the refrigeration cycle again. While a refrigeration system 10 with two compressors 12, a condenser 18, and an evaporator 20 is shown in FIG. 1, a refrigeration system 10 may be configured with any number of compressors 12, condensers 18, evaporators 20, or other refrigeration system components.

Each compressor 12 may be equipped with a control module (CM) 30 and a sensor module (SM) 32. SM 32 may monitor operating conditions of compressor 12 via communication with various operating condition sensors. For example, CM 30 may be connected to electrical voltage sensors, electrical current sensors, discharge temperature sensors, discharge pressure sensors, suction temperature sensors, suction pressure sensors, ambient temperature sensors, electric motor temperature sensors, compressor oil temperature sensors, compressor oil level sensors, compressor oil pressure sensors, and other compressor operating condition sensors.

Figure 2:
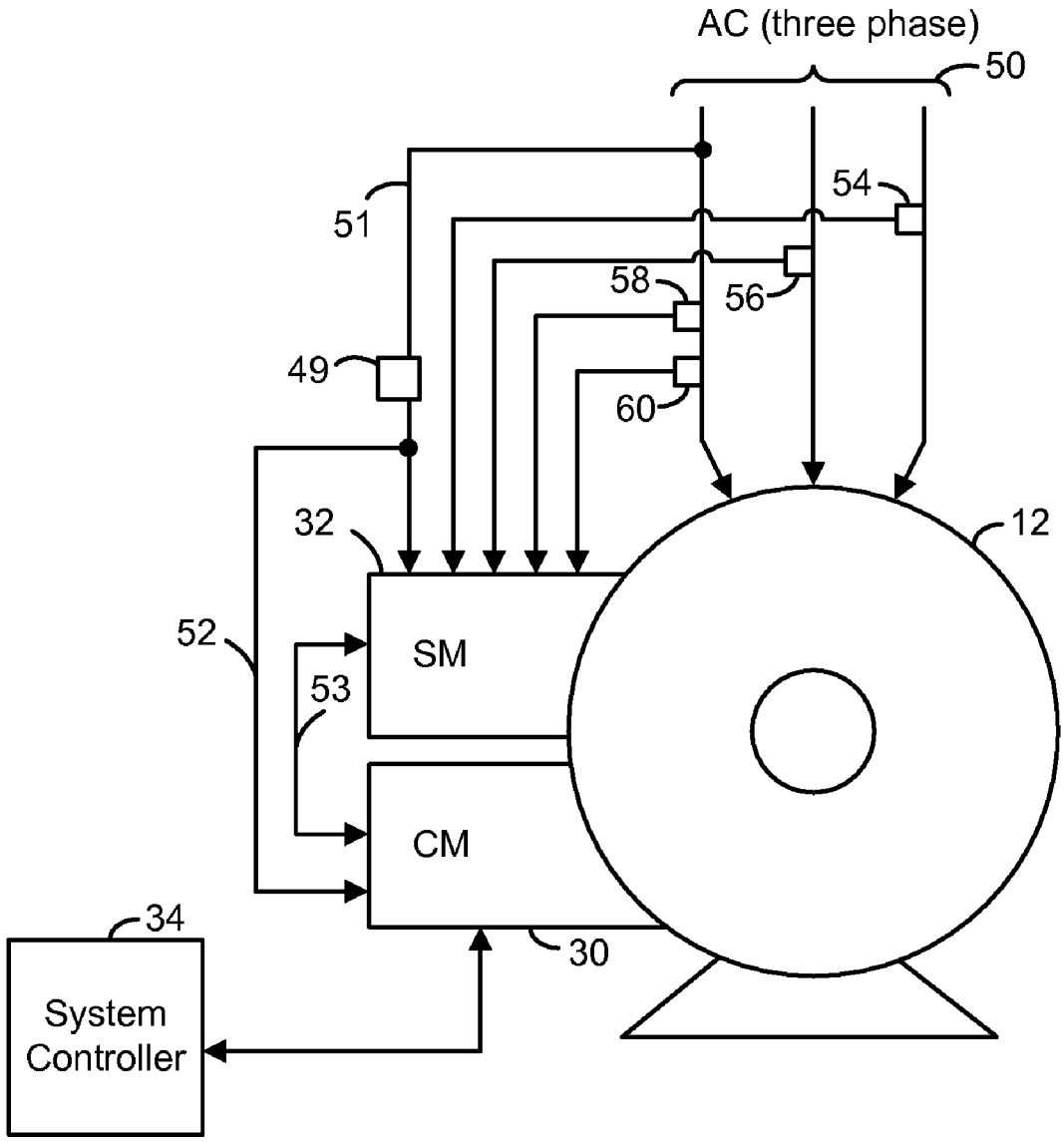
FIG. 2 is a schematic view of a compressor.

With reference to FIG. 2, three phase AC electric power 50 may be delivered to compressor 12 to operate an electric motor. SM 32 and CM 30 may receive low voltage power from one of the phases of electric power 50 delivered to compressor 12. For example, a transformer 49 may convert electric power 51 from one of the phases to a lower voltage for delivery to SM 32 and CM 30. In this way, SM 32 and CM 30 may operate on single phase AC electric power at a lower voltage than electric power 50 delivered to compressor 12. For example, electric power delivered to SM 32 and CM 30 may be 24V AC. When low voltage power, for example 24 V AC, is used to power CM 30 and SM 32, lower voltage rated components, such as lower voltage wiring connections, may be used.

CM 30 may control operation of the compressor 12 based on data received from SM 32, based on other compressor and refrigeration system data received from other compressor and refrigeration system sensors, and based on communication with a system controller 34. For example, CM 30 may be a protection and control system of the type disclosed in assignee's commonly-owned U.S. patent application Ser. No. 11/059,646, Publication No. 2005/0235660, filed Feb. 16, 2005, the disclosure of which is incorporated herein by reference. Other suitable protection and control type systems may be used.

By communicating with SM 32, CM 30 may monitor the various operating parameters of the compressor 12 and control operation of the compressor 12 according to protection and control algorithms and based on communication with system controller 34. CM 30 may activate and deactivate compressor 12 according to a set-point, such as a suction pressure, suction temperature, discharge pressure, or discharge temperature set-point. In the case of discharge pressure set-point, CM 30 may activate compressor 12 when discharge pressure, as determined by a discharge pressure sensor connected to SM 32, falls below the discharge pressure set-point. CM 30 may deactivate the compressor 12 when the discharge pressure rises above the discharge pressure set-point.

In this way, SM 32 may be specific to compressor 12 and may be located within an electrical enclosure 72 of compressor 12 for housing electrical connections to compressor 12 (shown in FIGS. 3, 5, and 6) at the time of manufacture of compressor 12. CM 30 may be installed on compressor 12 after manufacture and at the time compressor 12 is installed at a particular location in a particular refrigeration system, for example. Different control modules may be manufactured by different manufacturers. However, each CM 30 may be designed and configured to communicate with SM 32. In other words, SM 32 for a particular compressor 12 may provide data and signals that can be communicated to any control module appropriately configured to communicate with SM 32. Further, manufacturers of different control modules may configure a control module to receive data and signals from SM 32 without knowledge of the algorithms and computations employed by SM 32 to provide the data and signals.

System controller 34 may be used and configured to control the overall operation of the refrigeration system. System controller 34 is preferably an Einstein Area Controller offered by CPC, Inc. of Atlanta, Ga., or any other type of programmable controller that may be programmed to operate refrigeration system 10 and communicate with CM 30. System controller 34 may monitor refrigeration system operating conditions, such as condenser temperatures and pressures, and evaporator temperatures and pressures, as well as environmental conditions, such as ambient temperature, to determine refrigeration system load and demand. System controller 34 may communicate with CM 30 to adjust set-points based on such operating conditions to maximize efficiency of the refrigeration system. System controller 34 may evaluate efficiency of compressor 12 based on the operating data communicated to CM 30 from SM 32.

SM 32 may be connected to three voltage sensors 54, 56, 58, for sensing voltage of each phase of electric power 50 delivered to compressor 12. In addition, SM 32 may be connected to a current sensor 60 for sensing electric current of one of the phases of electric power 50 delivered to compressor 12. Current sensor 60 may be a current transformer or current shunt resistor.

When a single current sensor 60 is used, electric current for the other phases may be estimated based on voltage measurements and based on the current measurement from current sensor 60. Because the load for each winding of the electric motor may be substantially the same as the load for each of the other windings, because the voltage for each phase is known from measurement, and because the current for one phase is known from measurement, current in the remaining phases may be estimated.

Additional current sensors may also be used and connected to SM 32. For example, two current sensors may be used to sense electric current for two phases of electric power 50. When two current sensors are used, electric current for the remaining phase may be estimated based on voltage measurements and based on the current measurements from current sensors. Additionally, three current sensors may be used to sense electric current for all three phases of electric power.

In the case of a dual winding three phase electric motor, six electrical power terminals may be used, with one terminal for each winding resulting in two terminals for each of the three phases of electric power 50. In such case, a voltage sensor may be included for each of the six terminals, with each of the six voltage sensors being in communication with SM 32. In addition, a current sensor may be included for one or more of the six electrical connections.

Figure 5:
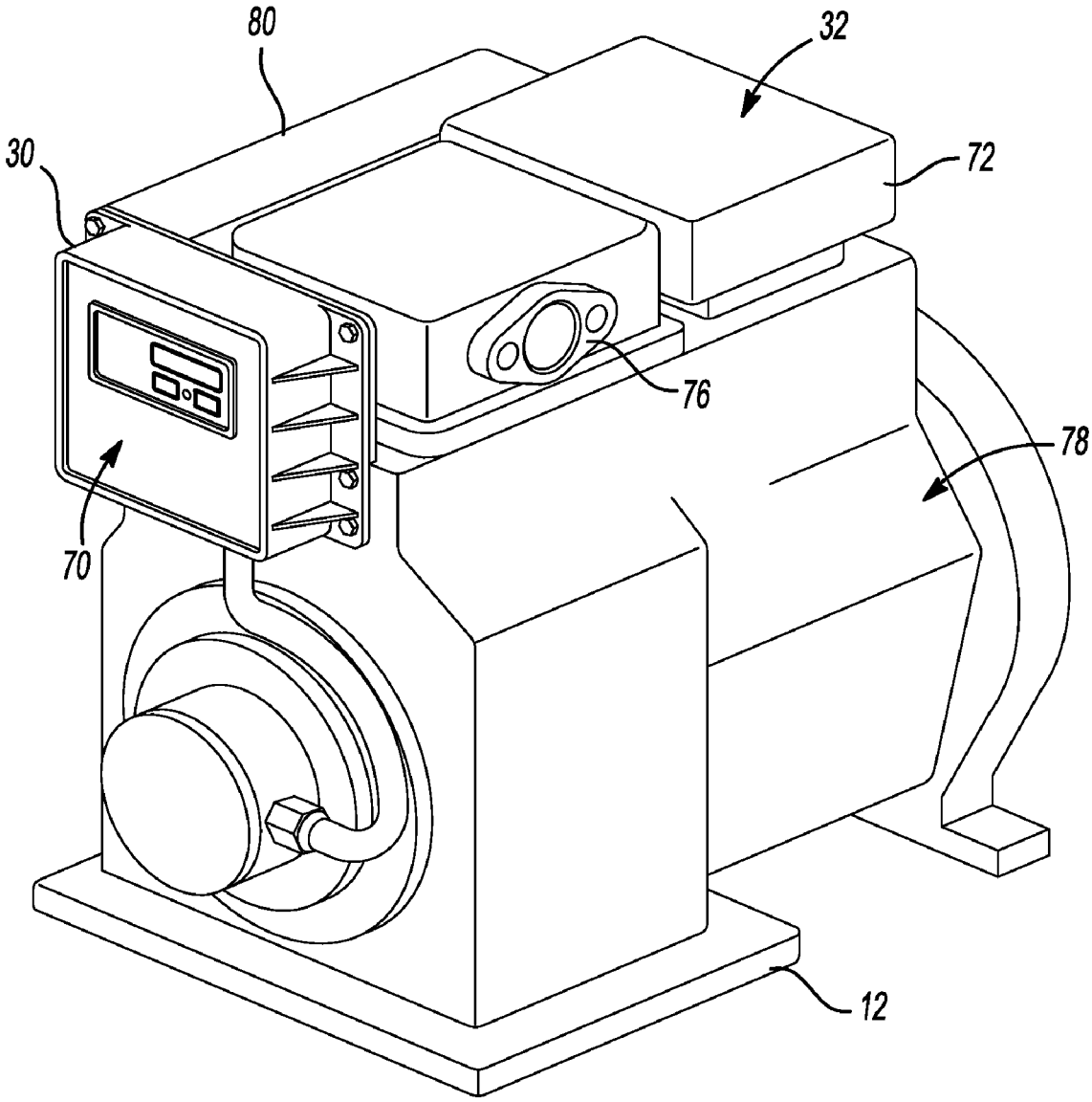
FIG. 5 is a perspective view of a compressor.
Figure 6:
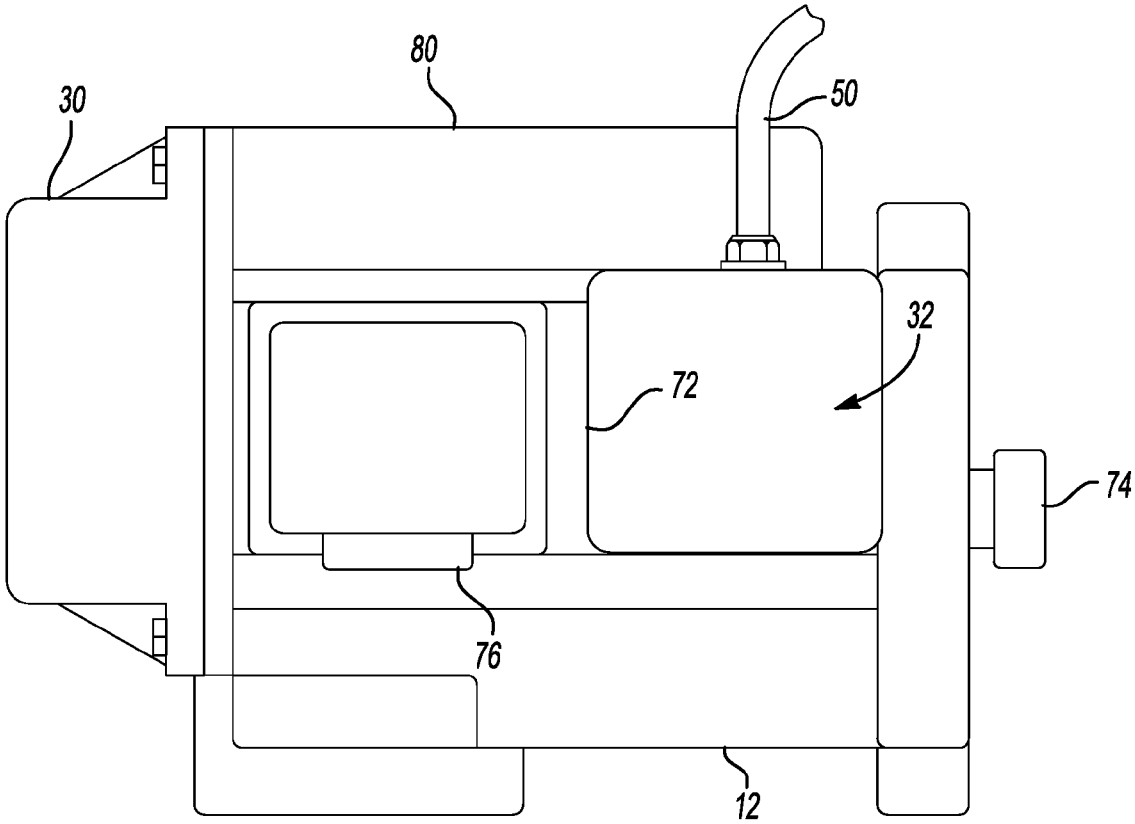
FIG. 6 is a top view of a compressor.

With reference to FIGS. 5 and 6, CM 30 and SM 32 may be mounted on or within compressor 12. CM 30 may include a display 70 for graphically displaying alerts or messages. As discussed above, SM 32 may be located within electrical enclosure 72 of compressor 12 for housing electrical connections to compressor 12.

Compressor 12 may include a suction nozzle 74, a discharge nozzle 76, and an electric motor disposed within an electric motor housing 78.

Electric power 50 may be received by electrical enclosure 72. CM 30 may be connected to SM 32 through a housing 80. In this way, CM 30 and SM 32 may be located at different locations on or within compressor 12, and may communicate via a communication connection routed on, within, or through compressor 12, such as a communication connection routed through housing 80.

Figure 3:
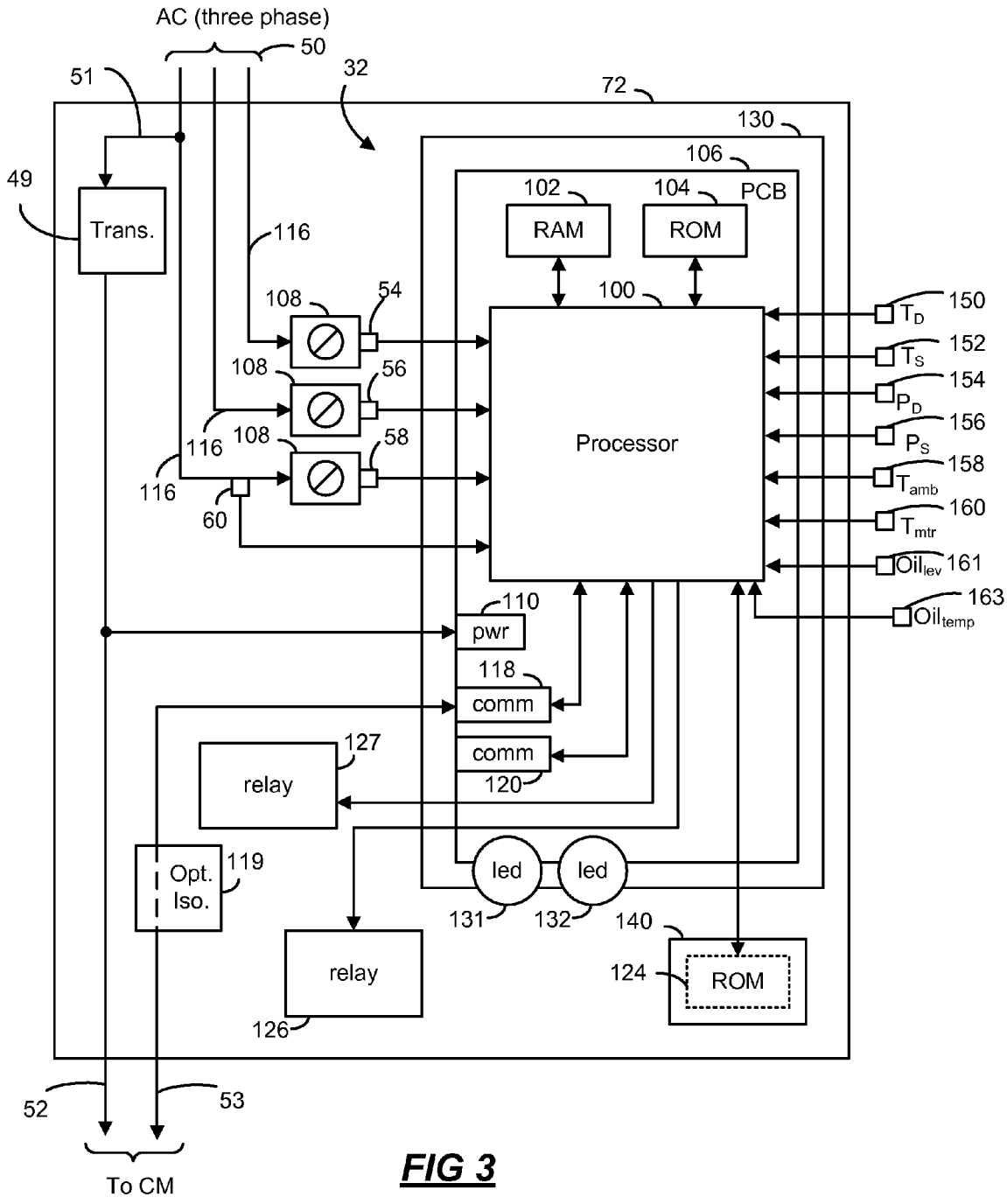
FIG. 3 is a schematic view of an electrical enclosure of a compressor including a sensor module.

With reference to FIG. 3, SM 32 may be located within electrical enclosure 72. In FIG. 3, a schematic view of electrical enclosure 72 and SM 32 is shown. SM 32 may include a processor 100 with RAM 102 and ROM 104 disposed on a printed circuit board (PCB) 106. Electrical enclosure 72 may be an enclosure for housing electrical terminals 108 connected to an electric motor of compressor 12. Electrical terminals 108 may connect electric power 50 to the electric motor of compressor 12.

Electrical enclosure 72 may include a transformer 49 for converting electric power 50 to a lower voltage for use by SM 32 and CM 30. For example, electric power 51 may be converted by transformer 49 and delivered to SM 32. SM 32 may receive low voltage electric power from transformer 49 through a power input 110 of PCB 106. Electric power may also be routed through electrical enclosure 72 to CM 30 via electrical connection 52.

Voltage sensors 54, 56, 58 may be located proximate each of electrical terminals 108. Processor 100 may be connected to voltage sensors 54, 56, 58 and may periodically receive or sample voltage measurements. Likewise, current sensor 60 may be located proximate one of electrical power leads 116. Processor 100 may be connected to current sensor 60 and may periodically receive or sample current measurements. Electrical voltage and current measurements from voltage sensors 54, 56, 58 and from current sensor 60 may be suitably scaled for the processor 100.

A discharge temperature sensor 150 may be connected to the processor 100 and may generate a discharge temperature signal corresponding to a discharge temperature of the compressor ($T_D$). A suction temperature sensor 152 may be connected to the processor and may generate a suction temperature signal corresponding to a suction temperature of the compressor ($T_S$). A discharge pressure sensor 154 may be connected to the processor 100 and may generate a discharge pressure signal corresponding to a discharge pressure of the compressor ($P_D$). A suction pressure sensor 156 may be connected to the processor 100 and may generate a suction pressure signal corresponding to a suction pressure of the compressor ($P_S$). An ambient temperature sensor 158 may be connected to the processor 100 and may generate an ambient temperature signal corresponding to an ambient temperature of the compressor ($T_{amb}$). An electric motor temperature sensor 160 may be connected to the processor 100 and may generate an electric motor temperature signal corresponding to an electric motor temperature of the compressor ($T_{mtr}$). An Oil level sensor 161 may be connected to processor 100 and may generate an oil level signal corresponding to a level of oil in compressor 12 ($Oil_{lev}$). An Oil temperature sensor may be connected to processor 100 and may generate an oil temperature signal corresponding to a temperature of oil in compressor 12 ($Oil_{Temp}$).

PCB 106 may include a communication port 118 to allow communication between processor 100 of SM 32 and CM 30. A communication link between SM 32 and CM 30 may include an optical isolator 119 to electrically separate the communication link between SM 32 and CM 30 while allowing communication. Optical isolator 119 may be located within electrical enclosure 72. Although optical isolator 119 is independently shown, optical isolator 119 may also be located on PCB 106. At least one additional communication port 120 may also be provided for communication between SM 32 and other devices. A handheld or portable device may directly access and communicate with SM 32 via communication port 120. For example, communication port 120 may allow for in-circuit programming of SM 32 a device connected to communication port 120. Additionally, communication port 120 may be connected to a network device for communication with SM 32 across a network.

Communication with SM 32 may be made via any suitable communication protocol, such as I2C, serial peripheral interface (SPI), RS232, RS485, universal serial bus (USB), or any other suitable communication protocol.

Processor 100 may access compressor configuration and operating data stored in an embedded ROM 124 disposed in a tamper resistant housing 140 within electrical enclosure 72. Embedded ROM 124 may be a compressor memory system disclosed in assignee's commonly-owned U.S. patent application Ser. No. 11/405,021, filed Apr. 14, 2006, U.S. patent application Ser. No. 11/474,865, filed Jun. 26, 2006, U.S. patent application Ser. No. 11/474,821, filed Jun. 26, 2006, U.S. patent application Ser. No. 11/474,798, filed Jun. 26, 2006, or U.S. Patent Application No. 60/674,781, filed Apr. 26, 2005, the disclosures of which are incorporated herein by reference. In addition, other suitable memory systems may be used.

Relays 126, 127 may be connected to processor 100. Relay 126 may control activation or deactivation of compressor 12. When SM 32 determines that an undesirable operating condition exists, SM 32 may simply deactivate compressor 12 via relay 126. Alternatively, SM 32 may notify CM 30 of the condition so that CM 30 may deactivate the compressor 12. Relay 127 may be connected to a compressor related component. For example, relay 127 may be connected to a crank case heater. SM 32 may activate or deactivate the crank case heater as necessary, based on operating conditions or instructions from CM 30 or system controller 34. While two relays 126, 127 are shown, SM 32 may, alternatively, be configured to operate one relay, or more than two relays.

Processor 100 and PCB 106 may be mounted within a housing enclosure 130. Housing enclosure 130 may be attached to or embedded within electrical enclosure 72. Electrical enclosure 72 provides an enclosure for housing electrical terminals 108. Housing enclosure 130 may be tamper-resistant such that a user of compressor 12 may be unable to inadvertently or accidentally access processor 100 and PCB 106. In this way, SM 32 may remain with compressor 12, regardless of whether compressor 12 is moved to a different location, returned to the manufacturer for repair, or used with a different CM 30.

LED's 131, 132 may be located on, or connected to, PCB 106 and controlled by processor 100. LED's 131, 132 may indicate status of SM 32 or an operating condition of compressor 12. LED's 131, 132 may be located on housing enclosure 130 or viewable through housing enclosure 130. For example, LED 131 may be red and LED 132 may be green. SM 32 may light green LED 132 to indicate normal operation. SM 32 may light red LED 131 to indicate a predetermined operating condition. SM 32 may also flash the LED's 131, 132 to indicate other predetermined operating conditions.

Additional current sensors may also be used and connected to SM 32. Two current sensors may be used to sense electric current for two phases of electric power 50. When two current sensors are used, electric current for the remaining phase may be estimated based on voltage measurements and based on the current measurements from current sensors. Three current sensors may be used to sense electric current for all three phases of electric power 50.

In the case of a dual winding three phase electric motor, electrical enclosure 72 may include additional electrical terminals for additional windings. In such case, six electrical terminals may be located within electrical enclosure 72. Three electrical terminals 108 may be connected to the three phases of electric power 50 for a first set of windings of the electric motor of compressor 12. Three additional electrical terminals may also connected to the three phases of electric power 50 for a second set of windings of the electric motor of compressor 12. Voltage sensors may be located proximate each of the additional electrical terminals. Processor 100 may be connected to the additional voltage sensors and may periodically receive or sample voltage and current measurements. For example, processor 100 may sample current and voltage measurements twenty times per cycle or approximately once every millisecond in the case of alternating current with a frequency of sixty mega-hertz.

Figure 4:
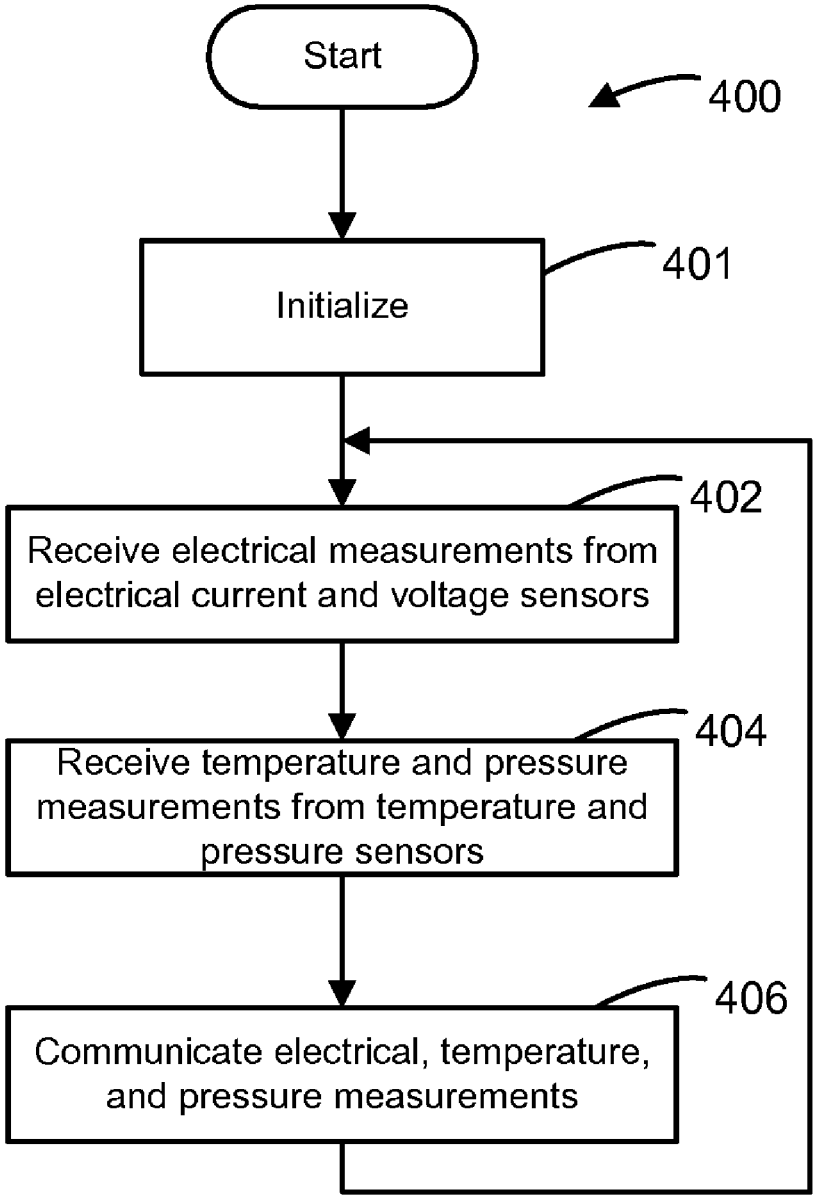
FIG. 4 is a flow chart illustrating an operating algorithm of a sensor module.

Referring now to FIG. 4, a flow chart illustrating an operating algorithm 400 for SM 32 is shown. In step 401, SM 32 may initialize. Initialization may include resetting any counters or timers, checking and initializing RAM 102, initializing any ports, including communication ports 118, enabling communication with other devices, including CM 30, checking ROM 104 on PCB 106, checking other ROM 124 such as an embedded memory system, and any other necessary initialization functions. SM 32 may load operating instructions from ROM 104 for execution by the processor 100.

In step 402, SM 32 may receive actual electrical measurements from connected voltage and current sensors 54, 56, 58, 60. SM 32 may receive a plurality of instantaneous voltage and current measurements over the course of a cycle of the AC electrical power. SM 32 may buffer instantaneous voltage and current measurements in RAM 102 for a predetermined time period.

In step 404, SM 32 may receive measurements from sensors 150, 152, 154, 156, 158, 160, 161, 163. SM 32 may buffer the instantaneous temperature and pressure measurements in RAM 102 for a predetermined time period.

In step 406, SM 32 may communicate electrical, temperature, and pressure measurements to CM 30. Alternatively, SM 32 may communicate electrical, temperature, and pressure measurements to a system controller 34 or to another communication device, such as a handheld device, connected to a communication port 120.

After communicating data in step 406, SM 32 may loop back to step 402 for continued monitoring and communication.

In this way, SM 32 may thereby provide efficient and accurate operating condition measurements of the compressor to be utilized by other modules and by users to evaluate operating conditions and efficiency of the compressor.

What is claimed is:

1. For a sensor module with a processor disposed within an electrical enclosure of a compressor having an electric motor, said electrical enclosure being configured to house electrical terminals for connecting said electric motor to a power supply at a first operating voltage, a method comprising:

connecting said sensor module to a transformer for generating a second operating voltage from said power supply, said first operating voltage being higher than said second operating voltage and said processor operating at said second operating voltage;

connecting said electrical terminals to said power supply operating at said first operating voltage;

receiving voltage measurements of said power supply from a voltage sensor connected to said sensor module;

receiving current measurements of said power supply from a current sensor connected to said sensor module;

communicating operating information based on said current and voltage measurements to a control module connected to said sensor module via a communication port of said sensor module.

2. The method of claim 1 further comprising:

receiving a temperature associated with said compressor from a temperature sensor connected to said sensor module;

communicating operating information based on said temperature to said control module;

wherein said temperature includes at least one of: a suction temperature of said compressor, a discharge temperature of said compressor, an ambient temperature, an oil temperature of said compressor, and an electric motor temperature of said compressor.

3. The method of claim 1 further comprising:

receiving a pressure associated with said compressor from a pressure sensor connected to said sensor module;

communicating operating information based on said pressure to said control module;

wherein said pressure includes at least one of: a suction pressure of said compressor and a discharge pressure of said compressor.

4. A system comprising:

a compressor having an electric motor operating at a first voltage;

a control module that controls said compressor; and a sensor module operating at a second voltage, said sensor module having a plurality of inputs connected to a plurality of sensors that generate a plurality of operating signals associated with operating conditions of said compressor, a processor connected to said plurality of inputs that records multiple operating condition measurements from said plurality of operating signals; and a communication port connected to said processor for communicating said operating condition measurements to said control module;

wherein said processor is disposed within an electrical enclosure of said compressor, said electrical enclosure being configured to house electrical terminals for connecting a power supply operating at said first voltage to said electric motor and wherein said second voltage is less than said first voltage.

5. The system of claim 4 further comprising a transformer located within said electrical enclosure that generates said second voltage from said power supply.

6. The system of claim 4 wherein said processor is disposed within a tamper-resistant enclosure within said electrical enclosure.

7. The system of claim 4 wherein said plurality of sensors includes a voltage sensor that generates a voltage signal corresponding to a sensed voltage of said power supply.

8. The system of claim 4 wherein said plurality of sensors includes a current sensor that generates a current signal corresponding to a sensed current of said power supply.

9. The system of claim 4 wherein said plurality of sensors includes at least one of a discharge temperature sensor that generates a discharge temperature signal corresponding to a discharge temperature of said compressor and a suction temperature sensor that generates a suction temperature signal corresponding to a suction temperature of said compressor.

10. The system of claim 4 wherein said plurality of sensors includes at least one of a discharge pressure sensor that generates a discharge pressure signal corresponding to a discharge pressure of said compressor and a suction pressure sensor that generates a suction pressure signal corresponding to a suction pressure of said compressor.

11. The system of claim 4 wherein said plurality of sensors includes at least one electric motor temperature sensor that generates an electric motor temperature signal corresponding to a temperature of said electric motor of said compressor.

12. The system of claim 4 wherein said plurality of sensors includes at least one of an oil temperature sensor that generates an oil temperature signal corresponding to a temperature of oil of said compressor, an oil level sensor that generates an oil level signal corresponding to an oil level of said compressor, and an oil pressure sensor that generates an oil pressure signal corresponding to an oil pressure of said compressor.

13. The system of claim 4 wherein said second voltage is between 18 volts and 30 volts.

14. The system of claim 4 wherein said second voltage is 24 volts.

15. A system comprising:

a compressor having an electric motor connected to a three phase power supply;

a control module that controls said compressor;

a sensor module powered by single phase power derived from said three phase power supply, the sensor module having a plurality of inputs connected to a plurality of sensors that generate a plurality of operating signals associated with operating conditions of said compressor, a processor connected to said plurality of inputs that records multiple operating condition measurements from said plurality of operating signals, and a communication port connected to said processor for communicating said operating condition measurements to a control module that controls said compressor;

wherein said processor is disposed within an electrical enclosure of said compressor, said electrical enclosure being configured to house electrical terminals for connecting said power supply to said electric motor and wherein an operating voltage of said single phase power is less than an operating voltage of said three phase power.

16. The system of claim 15 wherein said processor is disposed within a tamper-resistant enclosure within said electrical enclosure.

17. The system of claim 15 further comprising a transformer connected to said three phase power supply to generate said single phase power, said transformer being located within said electrical enclosure.

18. The system of claim 15 wherein said plurality of sensors includes a first voltage sensor that generates a first voltage signal corresponding to a voltage of a first phase of said three phase power supply, a second voltage sensor that generates a second voltage signal corresponding to a voltage of a second phase of said three phase power supply, and a third voltage sensor that generates a third voltage signal corresponding to a voltage of a third phase of said three phase power supply.

19. The system of claim 15 wherein said plurality of sensors includes a current sensor that generates a current signal corresponding to a current of one of said first, second, and third phases said three phase power supply.

20. The system of claim 15 wherein said operating voltage of said single phase power is between 18 volts and 30 volts.

21. The system of claim 15 wherein said operating voltage of said single phase power is 24 volts.

* * * * *

UNITED STATES PATENT AND TRADEMARK OFFICE

CERTIFICATE OF CORRECTION

PATENT NO. : 8,160,827 B2
APPLICATION NO. : 12/261677
DATED : April 17, 2012
INVENTOR(S) : Nagaraj Jayanth et al.

It is certified that error appears in the above-identified patent and that said Letters Patent is hereby corrected as shown below:

| | |
|---|---|
| Column 2, Line 14 | "generates" should be --generate--. |
| Column 3, Line 3 | After "phases" insert --of--. |
| Column 4, Line 66 | After "phases" insert --of--. |
| Column 9, Line 67 | After "also" insert --be--. |
| Column 12, Line 57 | After "phases" insert --of--. |

Signed and Sealed this
Thirty-first Day of July, 2012

David J. Kappos

David J. Kappos
*Director of the United States Patent and Trademark Office*